United States Patent [19]

Brandenburger et al.

[11] Patent Number: 4,809,381

[45] Date of Patent: Mar. 7, 1989

[54] APPARATUS FOR REMOVING MARINE GROWTH FROM PYLONS

[76] Inventors: Alan K. Brandenburger, 20592 Amapola; John R. Widly, 11155 Meads Ave., both of Orange, Calif. 92669

[21] Appl. No.: 148,067

[22] Filed: Jan. 25, 1988

[51] Int. Cl.[4] ..... A47L 7/00

[52] U.S. Cl. ..... 15/1.7; 15/409; 114/222

[58] Field of Search ..... 15/1.7, 409; 114/222

[56] References Cited

U.S. PATENT DOCUMENTS

| | | | |
|---|---|---|---|
| 3,444,584 | 5/1969 | Cote | 15/409 X |
| 3,808,631 | 5/1974 | Shibata et al. | 15/409 |
| 4,492,001 | 1/1985 | Hedrenius | 15/409 |

*Primary Examiner*—Edward L. Roberts
*Attorney, Agent, or Firm*—Jackson & Jones

[57] ABSTRACT

An underwater pylon cleaning apparatus is disclosed in which a rigid suction conduit mounted on an oceangoing vessel includes an eductor therein for providing a suction or lower pressure at the conduit inlet when water under pressure is supplied by a pump to the inlet of the eductor. A flexible hose connects an intake nozzle having an opening adapted to conform to the lateral surface of a cylindrical pylon to the inlet of the suction conduit. A discharge hose is connected to the outlet of the suction conduit by a flexible hose so that a diver may position the intake nozzle against the marine growth attached to the pylon whereby the growth will be removed from the pylon, transported through the hose and suction conduit and expelled through the outlet hose.

11 Claims, 2 Drawing Sheets

APPARATUS FOR REMOVING MARINE GROWTH FROM PYLONS

BACKGROUND OF THE INVENTION

1. Field of the Invention

The present invention relates to a method and apparatus for cleaning underwater pylons, and, more particularly, for removing marine growth, such as mussels, from pylons which support offshore platforms and the like.

2. Description of the Prior Art

Underwater pylons, which support structures such as offshore oil platforms, must be inspected periodically to insure that the integrity of the structure is still intact. Marine growth, such as mussels etc., continually accumulates on underwater structures from the surface of the water to about sixty feet below the surface. Such marine growth may extend out from the surface of the structure to twelve or more inches and must be removed prior to each inspection so that any deterioration of the pylons can be ascertained and repairs made or sections replaced.

In the past, divers have directed high velocity water streams against the pylons to remove the marine growth therefrom. The high velocity streams are issued from nozzles which deliver up to twenty gallons of water per minute at pressure up to sixty thousand pounds per square inch ("p.s.i."). The hoses and nozzles from which the high velocity streams issue are difficult for the divers to maneuver around the pylons. Furthermore, the high velocity streams are dangerous and require considerable skill on the part of the divers. As a result of the time and skill required to clean marine growth off of the pylons with the prior art apparatus the resulting cost is high.

Various devices have been devised in the prior art for cleaning underwater surfaces such as the hulls of ships, swimming pools etc. For example, U.S. Pat. No. 3,251,331 to W. R. Crawford discloses a hull cleaner in which a vacuum is created at the mouth of a wheeled carriage to cause water to flow between the mouth and the hull surface. The carriage is designed to be wheeled along the surface of the ship's hull so that the flow of water across the hull surface will dislodge the barnacles etc. The Crawford cleaner is designed to clean light marine growth, such as barnacles and algae, off of relatively smooth flat surfaces that are located near the water surface. The flat surface is necessary in order to enable carriage to create the necessary vacuum. Such a device would not be useful in removing a heavy accumulation of marine growth from relatively small diameter pylons.

U.S. Pat. Nos. 3,258,801 3,073,727 and 3,734,853 disclose devices for removing the debris from the bottom of swimming pools and aquariums. Such devices, however, would be of no use removing marine growth from underwater pylons. U.S. Pat. No. 2,204,584 to H. B. Flower discloses an apparatus for dredging the ocean floor to harvest shell fish therefrom. As in the Crawford device, this apparatus utilizes a vacuum cleaner type nozzle, which is designed to be moved across a relatively flat surface. The nozzle is designed to be rolled across the ocean floor by the dredging vessel. The vacuum cleaner type nozzles of Crawford and Flower could not be maneuvered around small diameter surfaces (e.g. 24 inches or less in diameter) such as the exterior surfaces of pylons and would not create sufficient vacuum on such a curved surface to dislodge the marine growth.

The disadvantages of the prior art techniques and apparatus for cleaning underwater pylons which support offshore platforms have been overcome by the present invention.

SUMMARY OF THE INVENTION

In accordance with the present invention, an elongated rigid suction conduit having an inlet and an outlet is mounted on an ocean going vessel so that during a cleaning operation the inlet extends below the water level. An intake nozzle having an opening adapted to conform to the lateral surface of a cylindrical pylon is connected to the inlet of the suction tube by means of a flexible inlet hose. A discharge hose is connected to the outlet of the suction tube and arranged so that the discharge end extends above the water level. An eductor is disposed in the suction tube intermediate the inlet and outlet thereof. The eductor includes an inlet arranged to be connected to a source of water under pressure so that water flowing through the inlet will entrain fluid molecules within the suction conduit and create a low pressure in the inlet of the suction conduit. One or more pumps are carried by the vessel and arranged to supply water under pressure to the inlet of the eductor so that when the intake nozzle is positioned on the surface of an underwater pylon the marine growth attached thereto will be dislodged from the pylon, carried by the stream of water entering the intake nozzle and discharged from the discharge hose.

In accordance with the method of the present invention water is forced through an elongated suction conduit having a flexible portion terminating in a discharge nozzle at one end and in an intake nozzle configured to conform to a cylindrical surface of a typical pylon at the other end, the water flow creating a low pressure area adjacent the intake nozzle. The intake nozzle is applied to successive areas along the surface of the pylons to thereby pull the marine growth off of the pylons and cause it to be carried through the conduit and discharged from the discharge nozzle.

The organization, operation and advantages of the present invention may be best understood from the following description taken in conjunction with the accompanying drawings.

DETAILED DESCRIPTION OF A PREFERRED EMBODIMENT OF THE INVENTION

Figure 1:
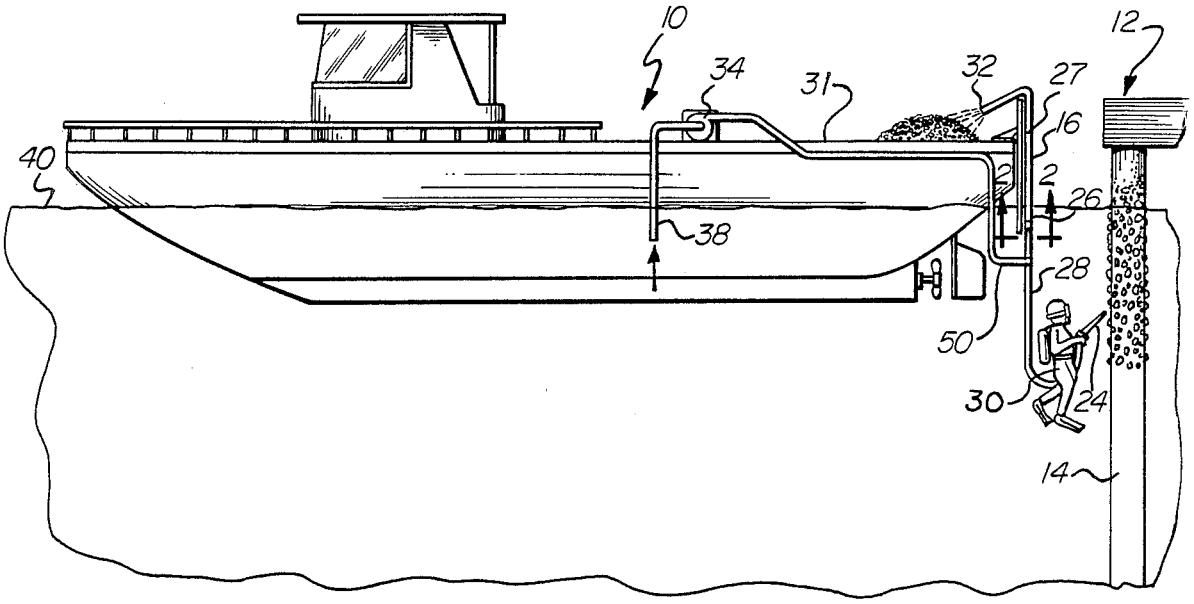
FIG. 1 is an elevational view of an ocean going vessel with the pylon cleaning apparatus of the present invention mounted thereon.
Figure 2:
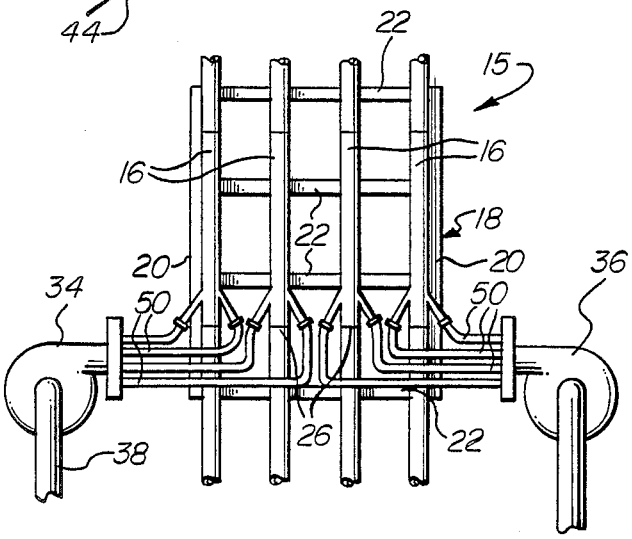
FIG. 2 is a partial end view of the pylon cleaning apparatus of FIG. 1, without the ocean going vessel, and illustrating four suction conduits mounted on a rack and two pumps for supplying water under pressure to the vacuum conduits.

Referring to FIG. 1, there is illustrated an ocean going vessel 10 and a portion of an offshore drilling platform 12 including a pylon 14. The pylon cleaning apparatus of the present invention including four rigid suction conduits 16 as shown, more particularly, in the end view of FIG. 2 is mounted on the stern of the vessel 10 by means of a rack 18. The rack 18 includes channel side members 20 and cross members 22 secured thereto by suitable means such as welding.

An intake nozzle 24 which is adapted to conform to the lateral surface of the pylons to be cleaned (i.e. perpendicular to the longitudinal axis of the pylon) is connected to an entrained liquid inlet 26 of each suction conduit by means of a flexible inlet hose 28. The intake nozzle preferably has a circular opening. A diver 30 is illustrated as maneuvering the intake nozzle 24 around the pylon 14. As will be explained in more detail, marine growth is pulled off of the pylon 14 by the low pressure (i.e. between seven to fifteen inches of mercury and preferably between nine to eleven inches of mercury water) created at the mouth of the nozzle 24, then passes through the inlet hose 28, the suction conduit 16 and is discharged onto the deck 31 of the vessel by means of a discharge nozzle 32. A pair of pumps 34 and 36 supply water under pressure to eductors located in each rigid suction conduit 16 to provide the low pressure at the intake nozzle 24. An inlet 38 for each pump is disposed below the surface 40 of the water.

Figure 3:
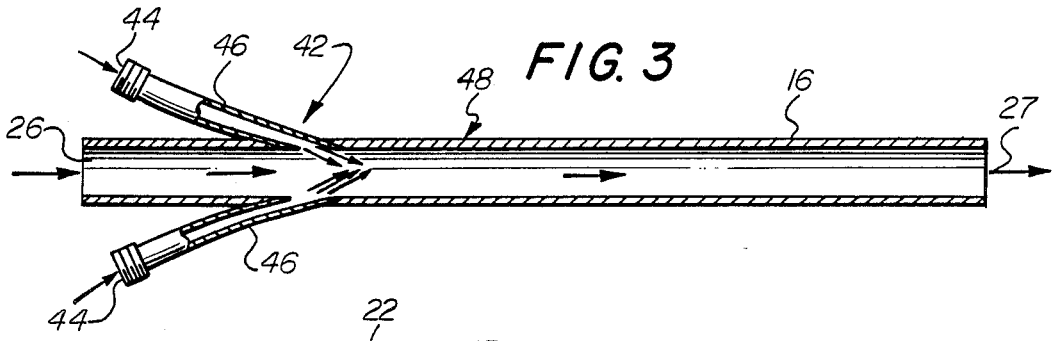
FIG. 3 is a cross-sectional view of one of the suction conduits of FIGS. 1 and 2 taken along line 2—2 illustrating the eductor arrangement used in the present invention.

Referring now to FIG. 3, each rigid conduit 16 includes the inlet 26, an outlet 27 and an eductor 42. The eductor 42 includes a carrier liquid inlet 44, a pair of eductor nozzles 46 connected to the inlet and entering into opposing sides of the conduit so that water exiting the nozzles is directed against the sides of a diffusion section 48 and toward the outlet 27. The eductor inlet 44 is connected to the outlet of a respective pump 34 or 36 by means of suitable high pressure hoses 50, as is illustrated more particularly in FIG. 2. The high velocity water streams, exiting the eductor nozzles 46, seal against the sides of the diffusion section 48 and create a low pressure or vacuum in the inlet 26 and in the intake nozzle 24.

The suction conduits 16 are preferably made of metal, which is resistant to corrosion by salt water, such as stainless steel. The length and diameter of the suction tubes are preferably about six feet and five inches, respectively. The eductor nozzles 46 are preferably formed from two inch pipes welded to the sides of the suction conduits. The pumps 34 and 36 may be designed to deliver three hundred (300) gallons of water per minute to each eductor nozzle at about ninety (90) p.s.i. The flexible inlet hoses 28 are preferably made of a suitable plastic such as polypropylene with a ribbed construction to maintain shape and having a density about equivalent to water. This enables the diver to maneuver the hose and intake nozzle under water with a minimum of effort.

Figure 4:
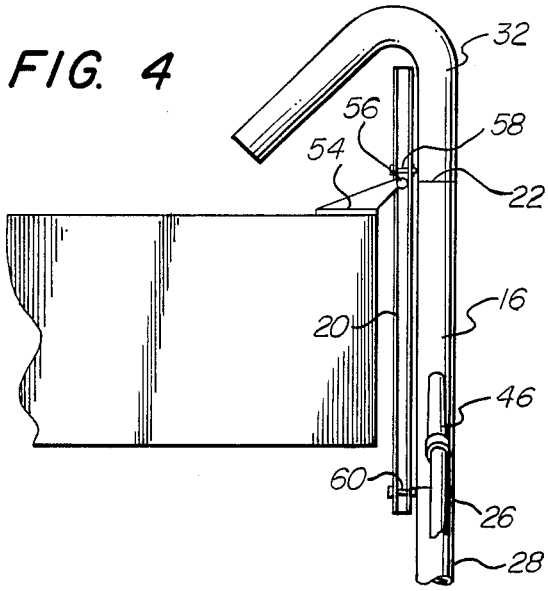
FIG. 4 is an elevational partial side view of the pylon cleaning apparatus of FIG. 1 enlarged to illustrate the manner in which the frame is secured to the vessel.
Figure 5:
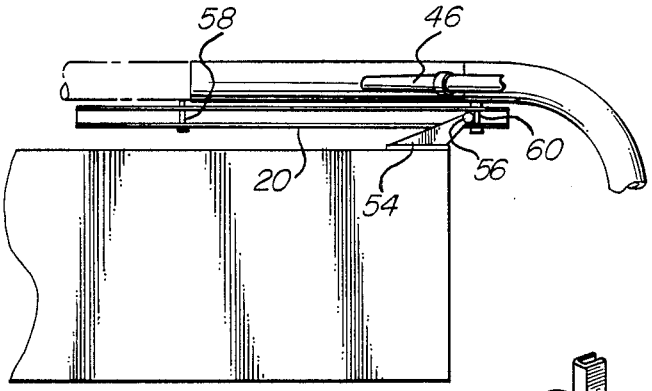
FIG. 5 is an enlarged partial side view of the apparatus of FIG. 4 showing the frame and suction conduits in a stored position.
Figure 6:
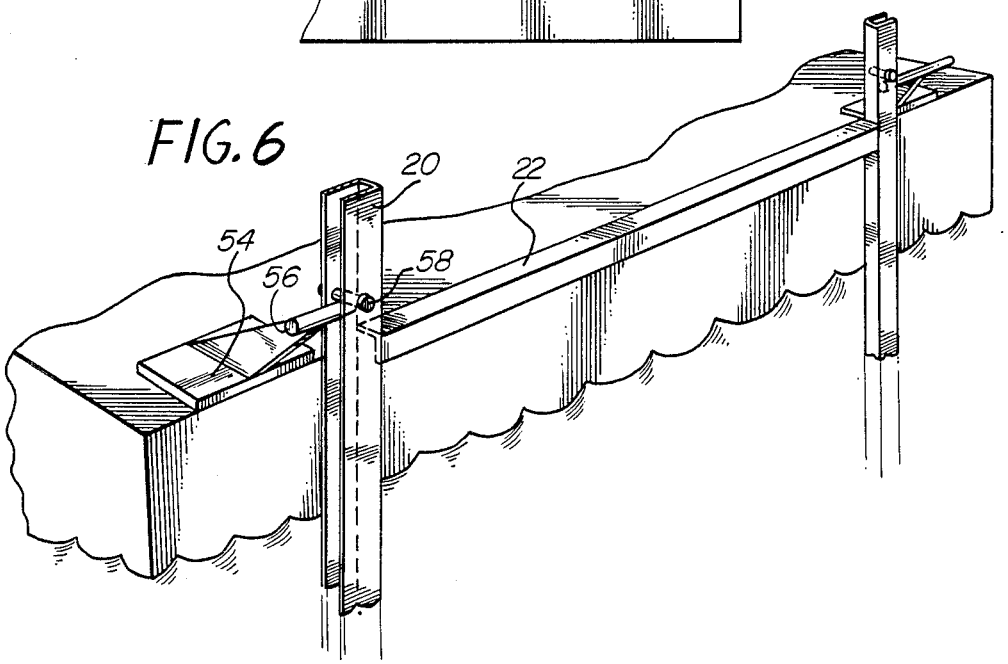
FIG. 6 is an enlarged perspective view of a portion of the rack of FIG. 4 illustrating in more detail the mounting arrangement therefore.

Referring now to FIGS. 4, 5 and 6 there is illustrated the mechanism for mounting the rack and suction conduits on the vessel. An anchor bracket 54 is suitably secured at each end of the stern of the vessel, for example by bolts, not shown. An anchor rod 56 is mounted on each anchor bracket 54 and extends parallel to the stern as is illustrated more particularly in FIG. 6. The open channel in each side member 20 of the frame 18 extends around one end of a respective anchor rod, as is best shown in FIG. 6, so that the frame 18 is prevented from moving relative to the vessel in a direction perpendicular to the plane of the frame. A pair of limit pins 58 and 60 are secured to the side member 20 for limiting the upward and downward movement of the frame 18. The operating position of the frame 18 and suction tubes 16 is illustrated in FIG. 4 and the stored position is illustrated in FIG. 5.

In operation the frame 16 and suction tubes are placed in the position illustrated in FIGS. 1 and 4 so that the eductors 42 are located below the water level to eliminate the need for priming. The pumps 34 and 36 are energized and divers are dispatched to maneuver the intake nozzles around the pylons to remove the marine growth thereform.

There has thus been described a novel method and apparatus for cleaning underwater pylons by removing the marine growth therefrom, which is much more efficient, less dangerous and more advantageous than the prior art.

What is claimed is:

1. In an apparatus arranged to be carried by an ocean-going vessel for removing marine growth from underwater pylons and the like the combination which comprises:

(a) an elongated rigid suction conduit having an inlet and an outlet;

(b) an intake nozzle having an opening adapted to conform to the lateral surface of an elongated cylindrical support structure;

(c) a flexible inlet hose connected between the inlet of the suction conduit and the intake nozzle;

(d) a discharge hose connected to the outlet of the suction conduit (e) an eductor disposed in the suction conduit intermediate the inlet and outlet thereof, the eductor having an inlet arranged to be connected to a source of water under pressure so that water flowing through the inlet of the eductor will entrain fluid molecules within the suction conduit and create a low pressure in the inlet of the suction conduit;

(f) pump means adapted to carried by the vessel for supplying water under pressure to the inlet of the eductor; and (g) means for mounting the suction conduit on the boat, so that the flexible inlet hose and eductor extends beneath the water level and the discharge end of the discharge hose extends above the water level.

2. The pylon cleaning apparatus of claim 1 wherein the eductor includes a diffusion section located upstream of the nozzle and the inlet of the eductor includes one nozzle disposed on each side of the tube and arranged so that water exiting the nozzles is directed toward the outlet of the suction conduit and against the sides of the diffusion section to provide a sealing action thereagainst.

3. The pylon cleaning apparatus of claim 2 including means for pivotally mounting the suction conduit on the boat so that the conduit can be positioned in a vertical position while in use and in a horizontal position extending over the deck of the boat in a stored position.

4. The pylon cleaning apparatus of claim 3 wherein the mounting means include an pair of anchor brackets secured to the boat above the deck thereof and a rack slidably and pivotally mounted on the anchor brackets, the suction conduit being mounted on the rack, whereby the rack and suction conduit are disposed in a vertical position with the portion of the tube containing the eductor located below the water level in the operating position and the rack and suction conduit disposed in a horizontal position above the boat deck in the stored position.

5. The pylon cleaning apparatus of claim 4 wherein the inlet hose is of a ribbed construction and has a density substantially equivalent to the density of water.

6. The pylon cleaning apparatus of claim 4 wherein the suction conduit has a diameter of about five inches and each eductor nozzle is arranged to discharge a stream of about 2 inches in diameter into the suction conduit.

7. The pylon cleaning apparatus of claim 6 wherein the anchor brackets are mounted on the stern of the vessel.

8. The pylon cleaning apparatus of claim 7 including a plurality of rigid suction conduits, flexible inlet hose and intake nozzle connected to the inlet of each suction conduit and a discharge hose connected to the outlet of each suction conduit.

9. The pylon cleaning apparatus of claim 8 including four suction conduits.

10. An underwater cleaning apparatus arranged to be carried by an ocean going vessel for removing marine growth from structures such as pylons which support offshore oil drilling platforms and the like, the combination which comprises:

(a) an eductor having a carrier liquid inlet, an elongated diffusion section located downstream from the carrier liquid inlet, an outlet disposal downstream from the diffusion section, and an apparatus chamber and an entrained liquid inlet in fluid communication with the apparatus;

(b) an intake nozzle having an opening adapted to conform to the lateral surface of a cylindrical support structure of about twenty inches in diameter;

(c) a flexible inlet hose connected between the intake nozzle and the entrained liquid inlet of the eductor;

(d) a discharge hose having an outlet connected to the outlet of the eductor;

(e) pump means adapted to be carried by the vessel for supplying water under pressure to the carrier liquid inlet of the eductor whereby water exiting the carrier liquid inlet will seal against the walls of the diffusion passage and entrain water molecules and thereby create a low pressure in the entrained liquid inlet and in the intake nozzle; and (f) means for mounting the eductor on the vessel so that during use the eductor and the outlet of the discharge hose extend below and above the surface of the water, respectively.

11. The cleaning apparatus of claim 10 including a plurality of eductors, an intake nozzle connected to the entrained liquid inlet of each eductor by a flexible inlet hose and a discharge hose connected to the outlet of each eductor.

* * * * *